United States Patent [19]

Brodeur et al.

[11] 4,359,001

[45] Nov. 16, 1982

[54] SIDE STAKE CONNECTOR FOR RAIL CARS

[75] Inventors: Rene H. Brodeur, Wilmette; Boris S. Terlecky, Fox Lake, both of Ill.

[73] Assignee: Railgon Company, Chicago, Ill.

[21] Appl. No.: 200,565

[22] Filed: Oct. 24, 1980

[51] Int. Cl.[3] ..... B65D 7/24; B61D 17/08

[52] U.S. Cl. ..... 105/406 R; 105/379; 105/409; 220/1.5; 220/6

[58] Field of Search ..... 105/406 R, 406 A, 380–391, 105/379; 220/1.5, 6

[56] References Cited

U.S. PATENT DOCUMENTS

| | | | |
|---|---|---|---|
| 2,651,268 | 9/1953 | Casciano | 105/379 |
| 3,253,556 | 5/1961 | Glaser et al. | 105/406 R |
| 3,315,835 | 4/1967 | Katzman | 220/6 |
| 3,421,453 | 1/1969 | Allen et al. | 105/406 R |
| 3,999,676 | 12/1976 | Trebilcock et al. | 220/6 |
| 4,177,907 | 12/1979 | Funaoili et al. | 220/1.5 |

*Primary Examiner*—Richard A. Bertsch

*Attorney, Agent, or Firm*—Jay G. Taylor; Robert V. Jambor

[57] ABSTRACT

Disclosed is a mounting connection for connecting side stakes of open top type rail cars such as gondolas and hoppers to the underframe of the rail car. The side stakes, which reinforce and support the side walls of the open top rail cars, are mounted to the underframe of the rail car by a tie strap rigidly connected to the underframe. The tie strap is pivotably mounted to the side stake by a transverse pin which allows the side stake to flex or pivot very slightly with respect to the underframe when forces are applied to the upper end of the side stake such as during loading thereby eliminating secondary bending moments and fracture at the junction of the underframe and the side stake.

4 Claims, 3 Drawing Figures

FIG-1
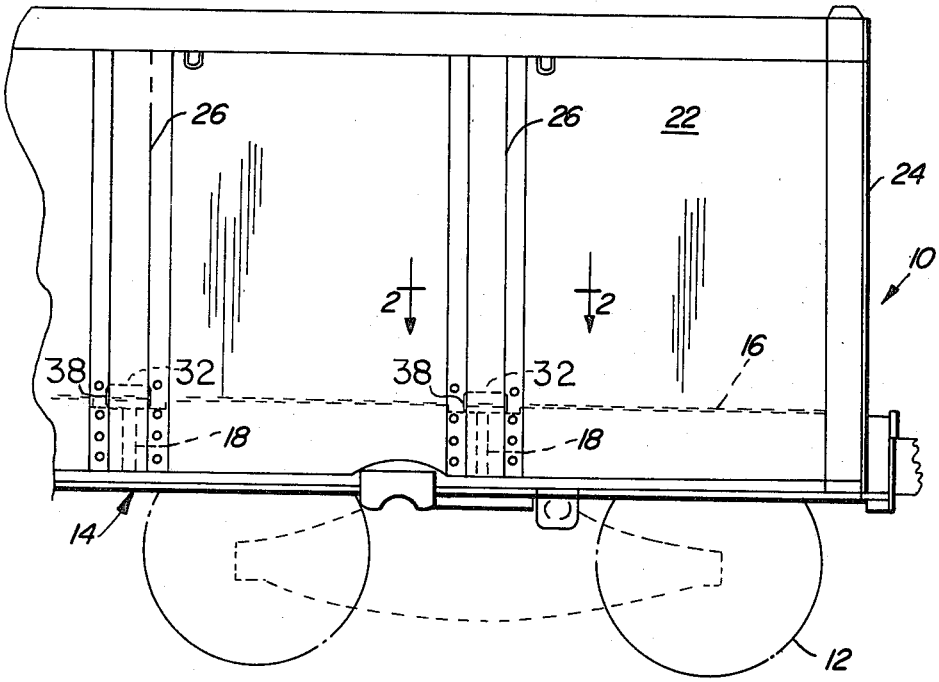
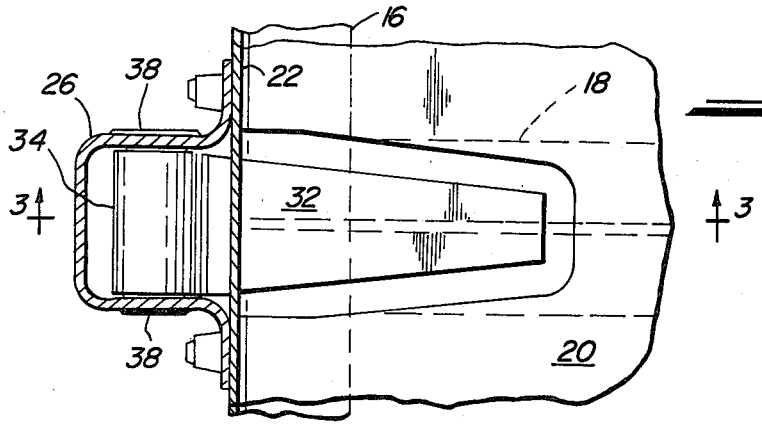
FIG-2
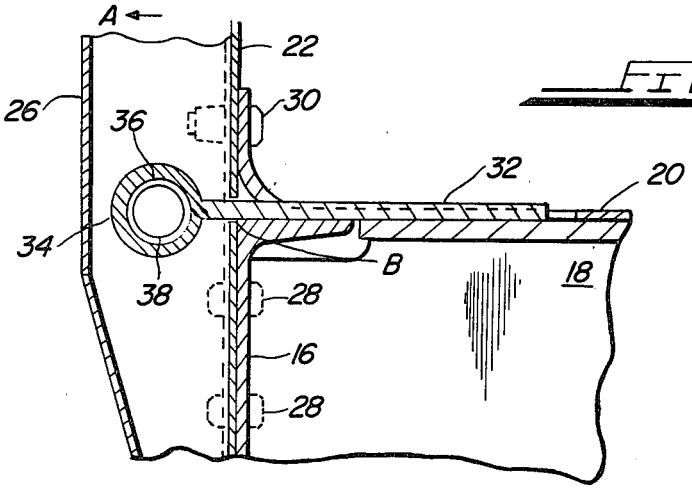
FIG-3

SIDE STAKE CONNECTOR FOR RAIL CARS

BACKGROUND OF THE INVENTION

1. Field of the Invention

The present invention relates to the construction of railroad cars, and more particularly, to a unique mounting arrangement for connecting the side stakes of open top rail cars to the underframe of the rail car that eliminate stress concentrations and unnecessary fracture.

2. Description of the Prior Art

Heretofore in the art, open top rail cars such as gondolas and hoppers, have experienced premature and unnecessary failure and breakage at the point of connection of the reinforcing side stake with the underframe of the rail car. These side stakes are mounted to the underframe and extend upwardly therefrom in an essentially cantilever fashion to support and reinforce the side walls of the rail car. Since open top rail cars have no top or roof structure to provide support for the upper portion, extreme forces often can be applied to the upper portion of the side stake during loading and unloading or when loads shift during starting, stopping and humping of rail cars.

Typically, the prior art rail cars have had the side stakes attached rigidly by welding. Accordingly, since the side stake may be as long as 8 to 10 feet, substantial leverage forces are created when force is applied to the upper end of the side stake. These forces are concentrated at the point of connection and the usable life of the rail cars are typically reduced as a result of premature unnecessary failure and breakage at the connecting junction of the side stake and underframe.

Since the means of connections heretofore used have not provided a direct connection between side stake and underframe at the upper point of contact, no direct means of providing a reaction moment has been provided in prior art rail car constructions. Accordingly, the present invention was developed to obviate the deficiencies in the prior art to provide a means of connecting the side stake to the underframe in such a manner as to provide the side stake with a direct tension connection which is pivotably attached to the side stake alleviating secondary bending moments at the point of connection.

BRIEF SUMMARY OF THE INVENTION

The present invention is an improvement for open top type rail cars. Such rail cars typically include wheel trucks for riding on steel rails, an underframe mounted on the wheel trucks, a floor for the rail car supported by the underframe and side and end walls mounted on the underframe and extending upwardly and essentially perpendicularly therefrom. Side stakes are also mounted to the vertical edge of the underframe and extend upwardly in a cantilever fashion and provide reinforcement and support for the side walls which are fabricated from thin gauge steel.

An improved connector for mounting the side stake to the underframe in accordance with the present invention comprises a pivot means for mounting the side stake in such a manner so as to provide a direct tension connection to the underframe if forces are applied to the upper end of the side stake. Thus in this manner, a direct tension portion of a reaction attachment moment has been provided—said direct tension connection being pivotably attached to the side stake to alleviate secondary bending moments at the point of connection.

More particularly, the pivot means comprises a tie strap which is rigidly mounted to the top of the underframe and extends outwardly from the edge of the underframe. The extended end of the tie strap is pivotably connected to the side stake by a pivot pin or other connection which allows slight pivotal movement.

Accordingly, it is a principal object of the present invention to provide a pivotably attached, direct connection for connecting a side stake to the underframe of an open top rail car which provides a direct tension component for the reaction attachment moment thereby eliminating premature and unnecessary detachment of the side stake at the point of connection.

Yet another object of the present invention is to provide a pivot means for connecting a side stake to the underframe of a rail car to alleviate secondary bending moments when forces are applied to the upper end thereof so that stress concentrations are eliminated.

These and other objects, advantages and features shall hereinafter appear, and for the purposes of illustration but not of limitation, an exemplary embodiment is illustrated in the appended drawings and described in the following detailed description.

BRIEF DESCRIPTION OF THE DRAWINGS

FIG. 1 is a side partially fragmentary view of an open top rail car having a side stake connector in accordance with the present invention.

FIG. 2 is a top cross-sectional partially fragmentary view taken substantially along line 2—2 in FIG. 1.

FIG. 3 is a side cross-sectional partially fragmentary view taken substantially along line 3—3 in FIG. 2.

DETAILED DESCRIPTION OF THE INVENTION

With reference to FIG. 1, an open top rail car 10 includes conventional wheel trucks 12 mounted at each end thereof in the conventional manner for traveling over steel rails. The wheel trucks are mounted to the underframe 14 of the rail car which generally comprises side beams 16 and cross beams 18 (see FIG. 3) joined together in rigid construction to form a load bearing frame. The underframe 14 supports a floor 20 of the rail car and side walls 22 and end walls 24 extend upwardly from the underframe 14 to form a rectangular load retaining area within the rail car. Side stakes 26 are mounted to the underframe 14 and extend upwardly therefrom to provide reinforcement and support for the relatively thin gauge steel side walls 22. The side stakes 26 are mounted at the lower end to the side beams 16 by rivets 28. The side frame is also connected by rivets 30 to an upbent edge of floor 20. Rivets 28 and 30 represent one of the conventional methods of attaching the side stake to the frame but in the present embodiment they are used to attach the side assembly of the car to the underframe (rivets 28), and to attach the floor plate flange to the side assembly (rivets 30). Rivets 28 provide load bearing support of the underframe to the side assembly.

In addition to rivets 28 and 30, the side stake is connected to the underframe by a tie strap 32 which is the principal load bearing connector for outwardly applied transverse loads as shown by arrow "A" in FIG. 3. Tie strap 32 is an elongated member having one end rigidly attached to the upper surfaces of the cross beam 18 by welding or some other suitable method of rigid connection. The other end of tie strap 32 has an enlarged portion 34 which extends beyond the edge of the underframe 14. The enlarged portion 34 has an opening 36 therethrough which is dimensioned to receive a pivot pin 38 which also extends through coincident openings in the side of side stake 26 to form a pivotal connection between the side stake 26 and the tie strap 32.

The pin 38 allows a slight degree of pivot rotation as tie strap 32 is stretched or elongated as a result of the stress without torque or bending moments being applied to tie strap 32.

Prior to the present invention, the transverse moment forces would tend to be concentrated at point B as shown in FIG. 3 in the prior art construction at the upper edge of the rigid connection between the side frame and side stake. Since such a prior art connection typically was by welding, no ability to form an efficient direct tension connection was provided. The present invention obviates this deficiency in the prior art by providing a direct tension connection between side stake and underframe; and further, provides this connection in a pivotable manner which eliminates secondary bending moments in the tension connection.

It should be apparent that various changes, alterations and modifications of the preferred embodiment as illustrated herein may be effectuated without departing from the spirit and scope of the present invention as defined in the appended claims and it should be readily recognized that various equivalent alterations, modifications or changes which provide an equivalent result could be embraced within the scope of the present invention.

We claim:

1. In an open top rail car including wheel trucks, an underframe mounted on the wheel trucks, a floor supported by the underframe, side walls and end walls mounted to the underframe and extending upwardly and essentially perpendicularly therefrom and side stakes mounted on a vertical edge of the underframe and extending upwardly along the surface of the side walls to reinforce the side walls, an improved connector for mounting the side stake to the underframe comprising:

a tie strap rigidly mounted to an upper surface of said underframe and extending outwardly from said underframe, said tie strap being pivotably connected to the side stake at a point above the lower end of said side stake so that external forces applied to the upper end of said side stake tending to cause outward bending of the side stake are applied to said tie strap at said pivotable connection placing said tie strap in tension and thereby eliminating any torsional bending forces from being applied to said tie strap at the point of connection.

2. An improved connector as claimed in claim 1 wherein said tie strap is an elongated member having an opening through said elongated member at one end thereof in a position that aligns with an opening in the side stake, and a pivot pin is positioned through both the opening in the tie strap and the opening in the side stake so that a pivotable connection is formed.

3. An improved connector as claimed in claim 2 wherein such pivotable connection allows the connector to provide a direct tension connection to resist outward forces applied to the upper end of the side stake without inducing secondary bending moments in the connector.

4. In an open top rail car including wheel trucks, an underframe mounted on the wheel trucks, a floor supported by the underframe, side walls and end walls mounted to the underframe and extending upwardly and essentially perpendicularly therefrom and side stakes mounted to the underframe and extending upwardly along the surface of the side walls to reinforce the side walls, an improved connector for mounting the side stake to the underframe comprising:

a tie strap rigidly mounted to the upper surface of the underframe, said tie strap having one end extending beyond the edge of said underframe, said one end having an opening therein;

a pivot pin positioned in said opening in said tie strap and extending through a coincident opening in the side stake to form a pivotable connection between the tie strap and the underframe so that the tie strap can pivot slightly to relieve secondary bending moments.

* * * * *